US011072944B2

(12) United States Patent
Peng

(10) Patent No.: US 11,072,944 B2
(45) Date of Patent: Jul. 27, 2021

(54) ELECTRONIC LOCK

(71) Applicants: FU CHANG LOCKS MFG. CORP., New Taipei (TW); LEON SPECIALTY INC., New Taipei (TW)

(72) Inventor: Fu-Chang Peng, New Taipei (TW)

(73) Assignees: FU CHANG LOCKS MFG. CORP., New Taipei (TW); LEON SPECIALTY INC., New Taipei (TW)

( * ) Notice: Subject to any disclaimer, the term of this patent is extended or adjusted under 35 U.S.C. 154(b) by 217 days.

(21) Appl. No.: 16/556,143

(22) Filed: Aug. 29, 2019

(65) Prior Publication Data

US 2021/0062543 A1 Mar. 4, 2021

(51) Int. Cl.
*E05B 47/00* (2006.01)
*G07C 9/00* (2020.01)

(52) U.S. Cl.
CPC ..... *E05B 47/0001* (2013.01); *G07C 9/00182* (2013.01); *G07C 2009/00214* (2013.01)

(58) Field of Classification Search
CPC ..... E05B 47/0001; E05B 47/068; E05B 2047/002; E05B 47/0012; G07C 9/00182; G07C 2009/00214
USPC ..... 70/277; 340/5.7, 5.73
See application file for complete search history.

(56) References Cited

U.S. PATENT DOCUMENTS 5,628,216 A * 5/1997 Qureshi ..... E05B 47/0012 292/201
5,694,798 A * 12/1997 Nunez ..... E05B 47/0661 70/224
5,712,626 A * 1/1998 Andreou ..... E05B 47/0661 340/5.67
6,279,360 B1 * 8/2001 Shen ..... E05B 3/06 70/224
7,845,201 B2 * 12/2010 Meyerle ..... G07C 9/00563 70/257
8,356,499 B2 * 1/2013 Peng ..... E05B 47/068 70/283
8,683,833 B2 * 4/2014 Marschalek ..... E05B 9/08 70/473
9,181,730 B1 * 11/2015 Peng ..... E05B 47/0001
9,273,489 B2 * 3/2016 Hickman ..... E05B 15/00
9,435,143 B2 * 9/2016 Shen ..... E05B 47/068
9,528,300 B2 * 12/2016 Moon ..... E05B 55/005
9,562,370 B2 * 2/2017 Ohl ..... G07C 9/00944
9,611,672 B2 * 4/2017 Murphy ..... E05B 13/004
10,208,508 B2 * 2/2019 Tien ..... E05B 47/0661
10,260,253 B2 * 4/2019 Moon ..... E05B 47/0692
(Continued)

*Primary Examiner* — Nam V Nguyen
(74) *Attorney, Agent, or Firm* — Leong C. Lei

(57) ABSTRACT

An improved structure of an electronic lock includes an outside-door assembly, a lock middle, an inside-door assembly, and a latch. The outside-door assembly is mounted to an outer side of a door panel. The lock middle is connected to the outside-door assembly. The inside-door assembly is connected to the lock middle and is mounted to an inner side of the door panel. The latch is connected to the latch coupler. With a code entered, an electrically-driven valve of the lock middle causes a guide block and a projection block to extend outward to have an outside handle and the lock middle to synchronously operate for opening the door. Alternatively, a key may be used to open the door. If such a code and a key are both not available, the outside handle and the lock middle do not synchronously operate.

6 Claims, 13 Drawing Sheets

(56) References Cited

U.S. PATENT DOCUMENTS

| | | | | |
|---|---|---|---|---|
| 10,267,063 | B2 * | 4/2019 | Lin | E05B 63/04 |
| 2016/0251876 | A1 * | 9/2016 | Carlsson | E05B 47/0665 70/445 |

* cited by examiner

ELECTRONIC LOCK

TECHNICAL FIELD OF THE INVENTION

The present invention relates to a lock mounted to a door, and more particularly to an electronic lock having a more stable and more durable structure and involving a reduced number of parts.

DESCRIPTION OF THE PRIOR ART

With the advance of technology and science, modern people place more and more attention to home security and life and property safety. Thus, the requirement for door security is increasingly server. To prevent burglary, modern people often install multiple locks in the residence to ensure home security.

To effectively improve home security, electronic door locks are available in the market, which, in use, require input of a preset code and a key must be used for entry. Although such electronic door locks greatly improve security, once a user forgets the code or does not bring a key, a door handle must be forcibly turned to break the electronic lock in order to get into the house. However, the electronic lock so broken is cannot be re-used, making it necessary for the user to spend additional costs for purchases and maintenance and also providing the burglars a chance for easily breaking in. Thus, this would become a risky situation. Apparently, the prior art devices still have various disadvantages and are not of perfect designs and improvement is extremely necessary.

SUMMARY OF THE INVENTION

An objective of the present invention is to provide an improved structure of an electronic lock, such that with the design and application of the present invention for being used in combination with an electronic product and a door lock, a user does not need to open a door lock with a key.

An improved structure of electronic lock that achieves the above objective of the invention comprises: an outside-door assembly, wherein the outside-door assembly is mounted to an outer side of a door panel and comprises an outside handle, an outside escutcheon, an outside handle arrestor, and an outside mounting board, the outside arrestor penetrating through the outside escutcheon and coupled with the outside handle to be located at one side of the outside mounting board; a lock middle, which is connected to the outside-door assembly and comprises a lock middle body, elastic elements, a latch coupler, an electrically-driven valve, a first arresting member, a ring, a lock middle housing, a second arresting member, and a body mounting member, wherein the latch coupler is connected to the elastic elements and then coupled to the lock middle body, the electrically-driven valve penetrating through the first arresting member and the lock middle body and then, the ring and the lock middle housing being fit, in sequence, to the first arresting member and the lock middle body, the second arresting member penetrating through the lock middle body to be mounted by the body mounting member to the lock middle body; an inside-door assembly, wherein the inside-door assembly is connected to the lock middle and is mounted at an inner side of the door panel and comprises an inside handle, an inside escutcheon, an inside handle arrestor, and the inside mounting board, the inside arrestor penetrating through the inside escutcheon and coupled to the inside handle to be located at one side of the inside mounting board; a latch, which is coupled to and is operable in combination with the latch coupler.

By means of the technical solution adopted in the present invention, with the design and application of the present invention as being coupled to an electronic product and a door lock, when a user enters a correct code, the electrically-driven valve of the lock middle causes the guide block and the projection block to extend outward and in stopping engagement to have the outside handle and the lock middle to synchronously operate for opening the door; if no such a code is provided, a key may be used to open the door; if such a code and a key are both not available, the outside handle and the lock middle do not synchronously operate, so that the structure of the electronic lock can be effectively protected and do not easily damage.

DETAILED DESCRIPTION OF THE PREFERRED EMBODIMENT

Figure 1:
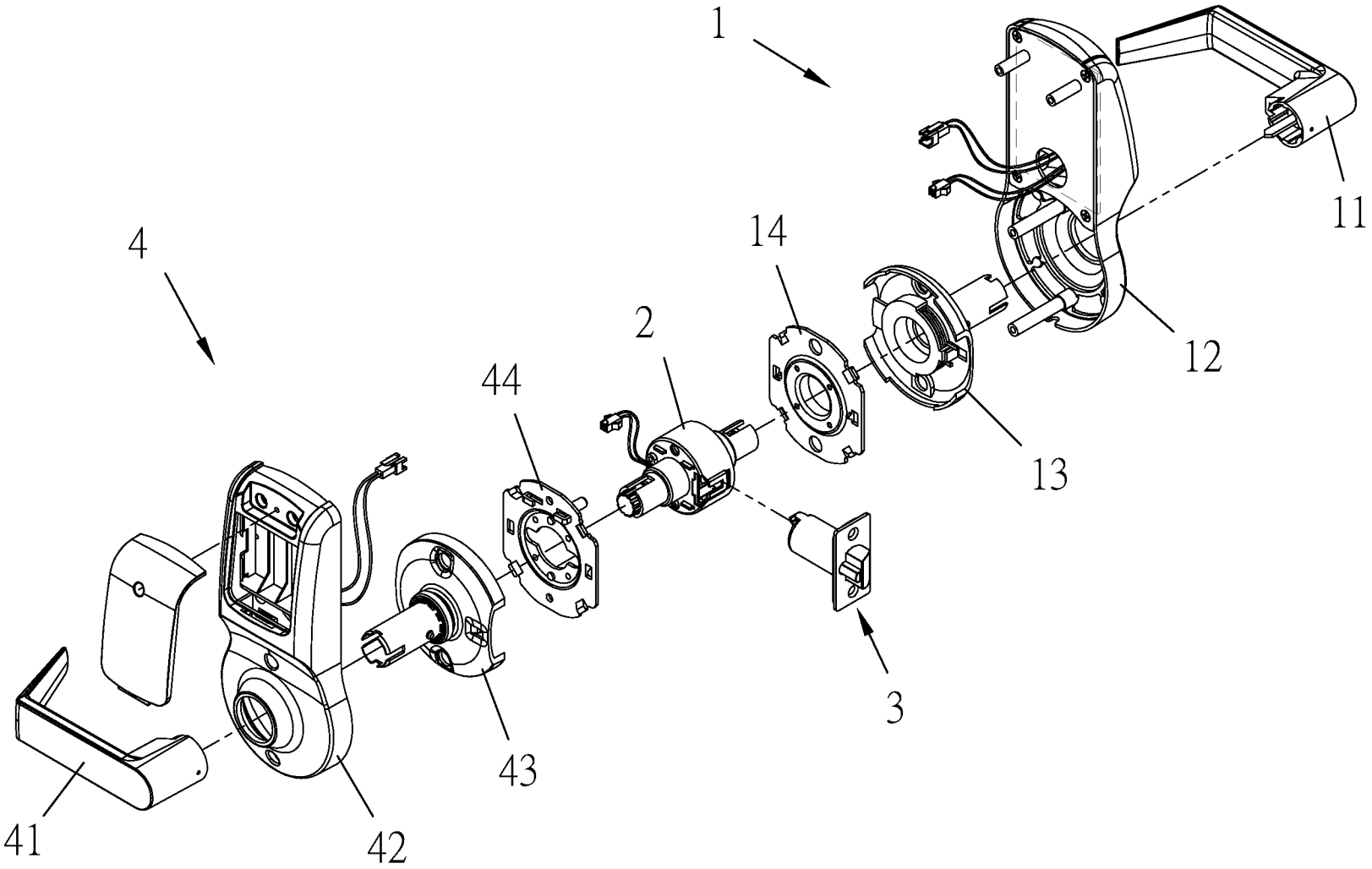
FIG. 1 is an exploded view of the present invention.
Figure 2:
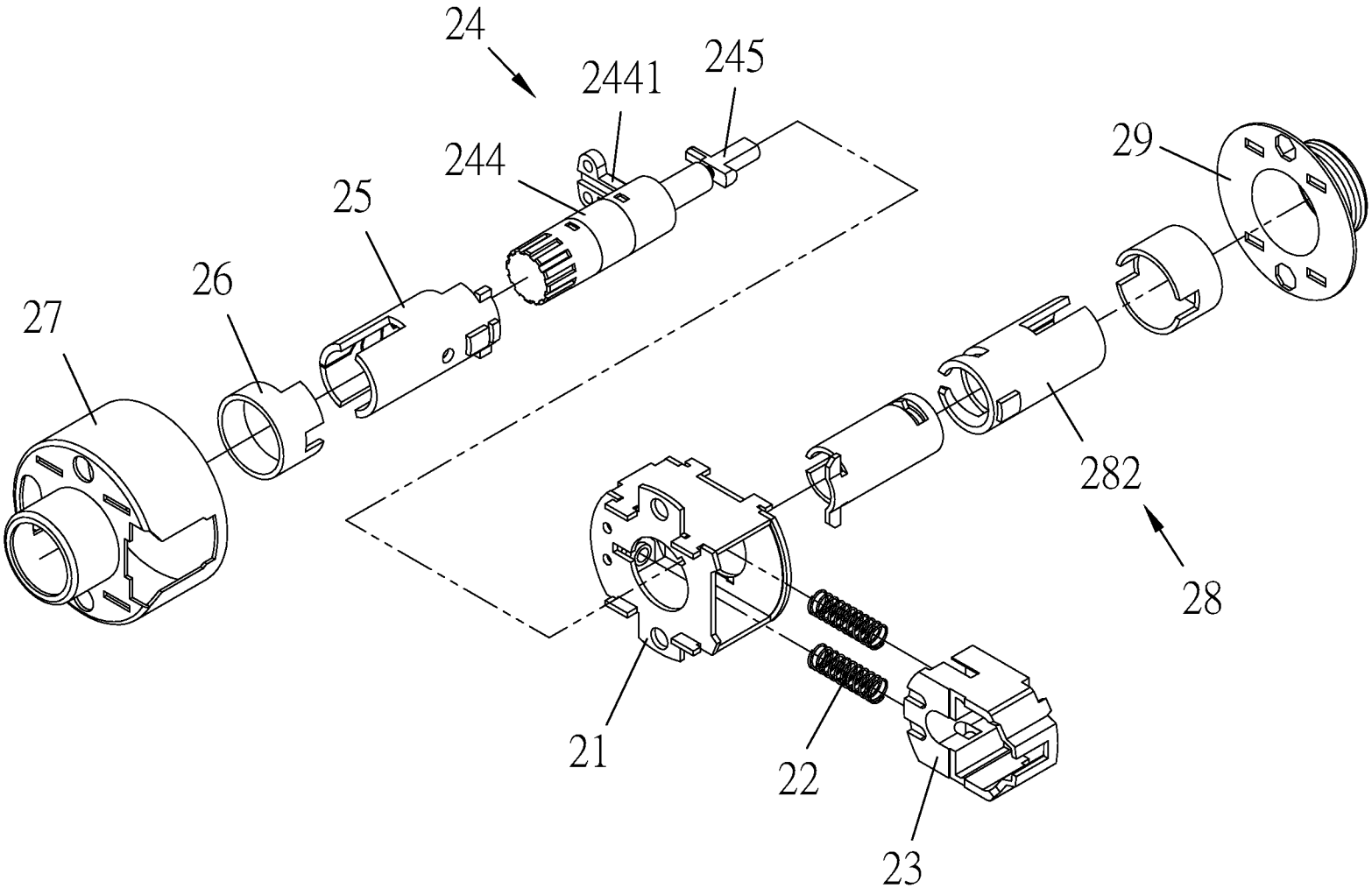
FIG. 2 is an exploded view of a lock middle of the present invention.
Figure 5:
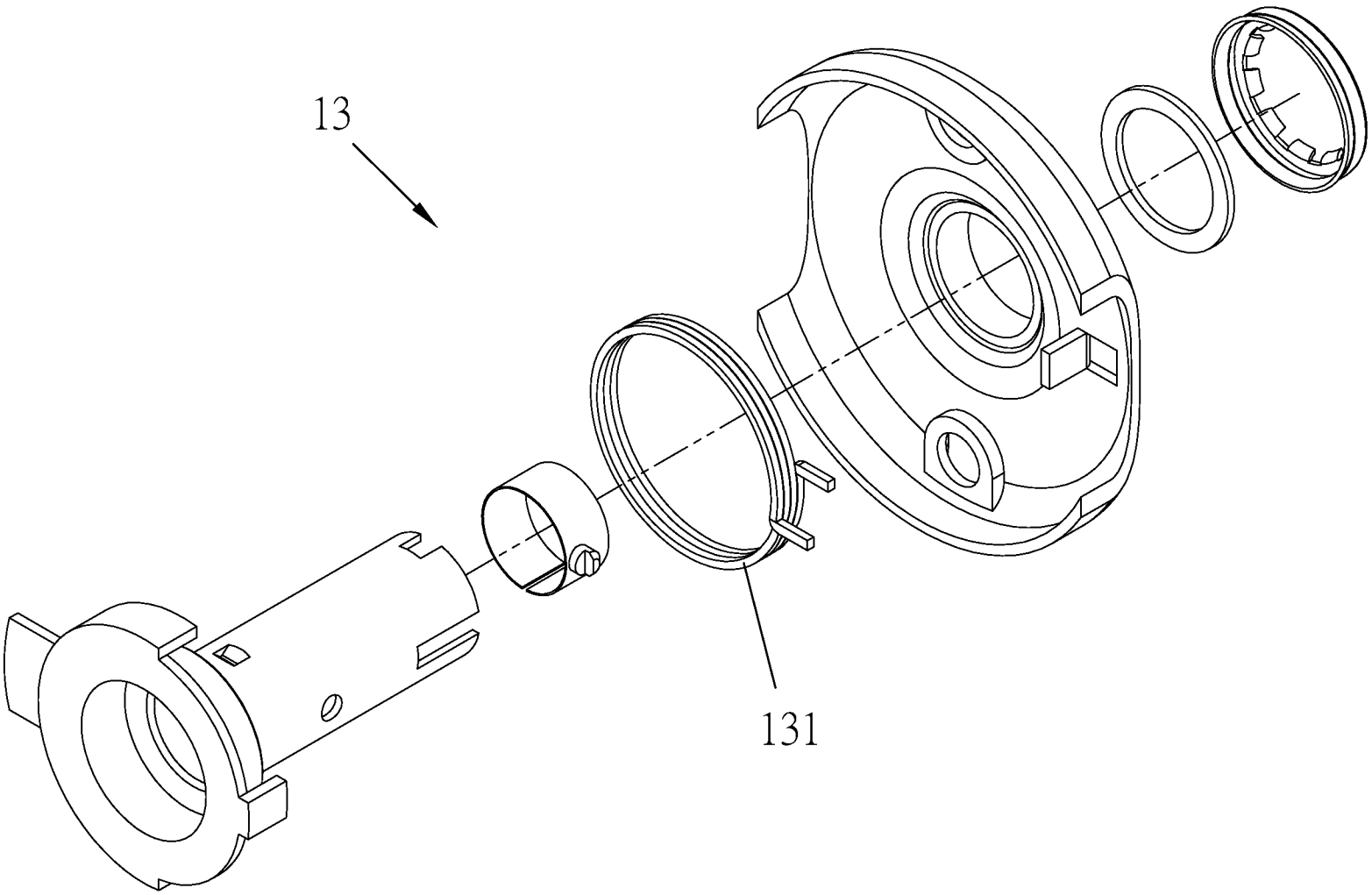
FIG. 5 is an exploded view of an outside handle arrestor of the present invention.

Referring to FIG. 1, an exploded view of the present invention is provided, in which an outside-door assembly 1 is shown. The outside-door assembly 1 is mounted to an outer side of a door panel and comprises an outside handle 11, an outside escutcheon 12, an outside handle arrestor 13, and an outside mounting board 14, wherein the outside handle arrestor 13 penetrates through the outside escutcheon 12 to couple to the outside handle 11 and is arranged at one side of the outside mounting board 14;

a lock middle 2, which is connected with the outside-door assembly 1;

an inside-door assembly 4, wherein the inside-door assembly 4 is connected with the lock middle 2 and is mounted to an inner side of the door panel and comprises an inside handle 41, an inside escutcheon 42, an inside handle arrestor 43, and an inside mounting board 44, wherein the inside handle arrestor 43 penetrates through the inside escutcheon 42 to couple to the inside handle 41 and is arranged at one side of the inside mounting board 44;

a latch 3, which is connected to and is operable in combination with a latch coupler 23 (shown in FIG. 2);

wherein, as shown in FIG. 5, the outside handle arrestor 13 and the inside handle arrestor 43 include a torsion spring 131 for position returning for leftward and rightward rotations, so that an improved structure of an electronic lock is formed.

The outside handle includes a keyway, a lock core, and an extended bar, which are connected to each other and are operable in combination with each other, wherein the extended bar penetrates through the outside handle arrestor 13 and is coupled to the lock middle 2, so that when a user uses a key to open the handle, the keyway drives and moves the lock core, and the lock core drives and moves the extended bar, and the extended bar drives and moves the lock middle 2 so as to perform an opening operation.

Figure 3:
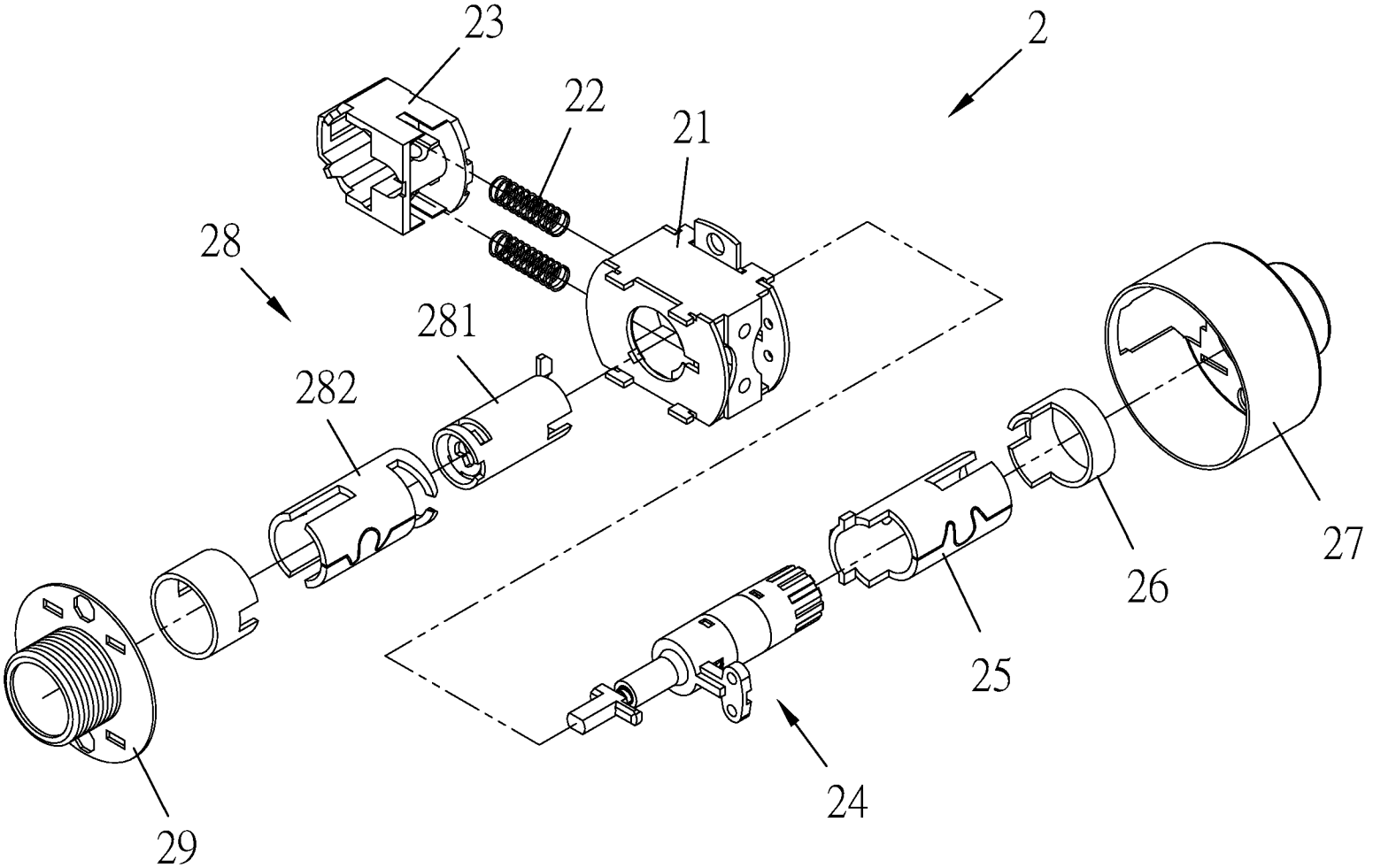
FIG. 3 is a view, taken from a different perspective, as a continuation of FIG. 2.

Referring to FIGS. 2 and 3, a partly exploded view of the present invention and another partly exploded view taken from a different perspective are provided, and as shown in the drawings, the lock middle 2 comprises: a lock middle body 21, elastic elements 22, a latch coupler 23, an electrically-driven valve 24, a first arresting member 25, a ring 26, a lock middle housing 27, a second arresting member 28, and a body mounting member 29, wherein the latch coupler 23 is connected to the elastic elements 22 and then connected to the lock middle body 21, and the electrically-driven valve 24 penetrates through the first arresting member 25 and the lock middle body 21, and then the ring 26 and the lock middle housing 27 are fit, in sequence, to the first arresting member 25 and the lock middle body 21, and the second arresting member 28 penetrates through the lock middle body 21 and is mounted by the body mounting member 29 to the lock middle body 21, so that with the above elements, the lock middle 2 according to the present invention is made.

Figure 4:
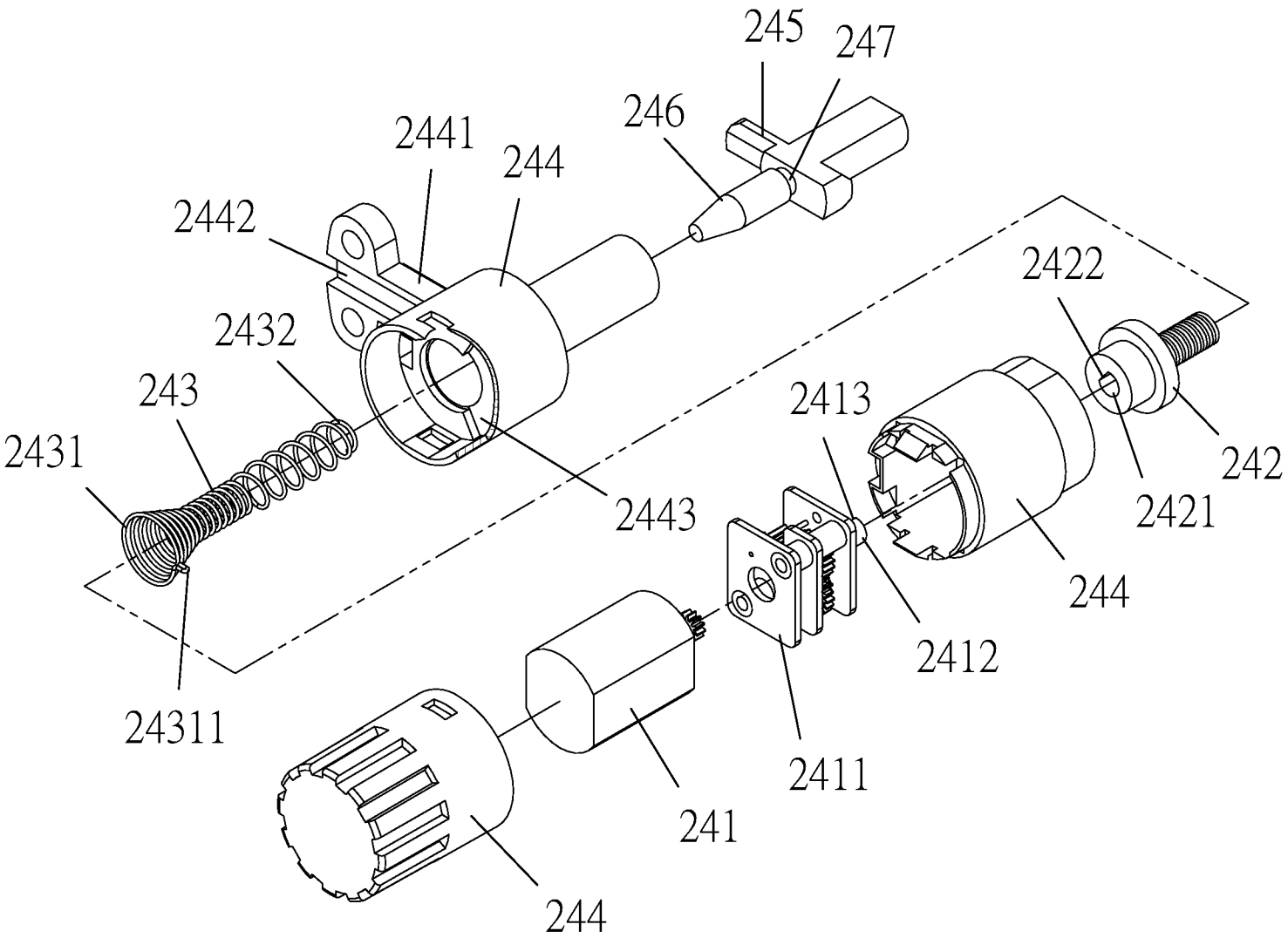
FIG. 4 is an exploded view of an electrically-driven valve of the present invention.

Referring to FIG. 4, a partly exploded view, partially sectioned, is provided for illustrating the present invention, which, as shown in the drawing, comprises: a motor 241, a reduction gear train 2411, a rotary member 242, an elastically extendable/contractable element 243, a valve casing 244, a guide block 245, and a projection block 246, wherein the valve casing 244 is extended from one side to form a fixing section 2441, and the fixing section 2441 is provided with a groove 2442, and two sides of the fixing section 2441 are coupled to the lock middle body 21;

the motor 241 is connected to the reduction gear train 2411, and the reduction gear train 2411 comprises a transmission axle 2412, and the transmission axle 2412 is coupled to the rotary member 242 and is received in the valve casing 244, and conductor wires of the motor 241 are arranged in the groove 2442;

the elastically extendable/contractable element 243 include a first end section 2431 and a second end section 2432, wherein the first end section 2431 is extended outward to form a stop section 24311, and an opposite end of the rotary member 242 is coupled to the first end section 2431 of the elastically extendable/contractable element 243 and is received in the valve casing 244, and the valve casing 244 has an inside surface that is recessed to form a limiting section 2443, and the stop section 24311 is positioned in the limiting section 2443, and the guide block 245 and the projection block 246 are integrally formed together as a unitary structure, and the guide block 245 and the projection block 246 include an engaging section 247 arranged therebetween, such that the second end section 2432 of the elastically extendable/contractable element 243 is coupled to the engaging section 247.

The transmission axle 2412 includes a first flat plane section 2413. The rotary member 242 includes, at an end thereof, an insertion hole 2421. The insertion hole 2421 includes a second flat plane section 2422. The transmission axle 2412 is inserted in the insertion hole 2421, so that the first flat plane section 2413 and the second flat plane section 2422 are in contact engagement with each other, so that fixing between the transmission axle 2412 and the rotary member 242 can be enhanced to make detachment difficult.

Figure 6:
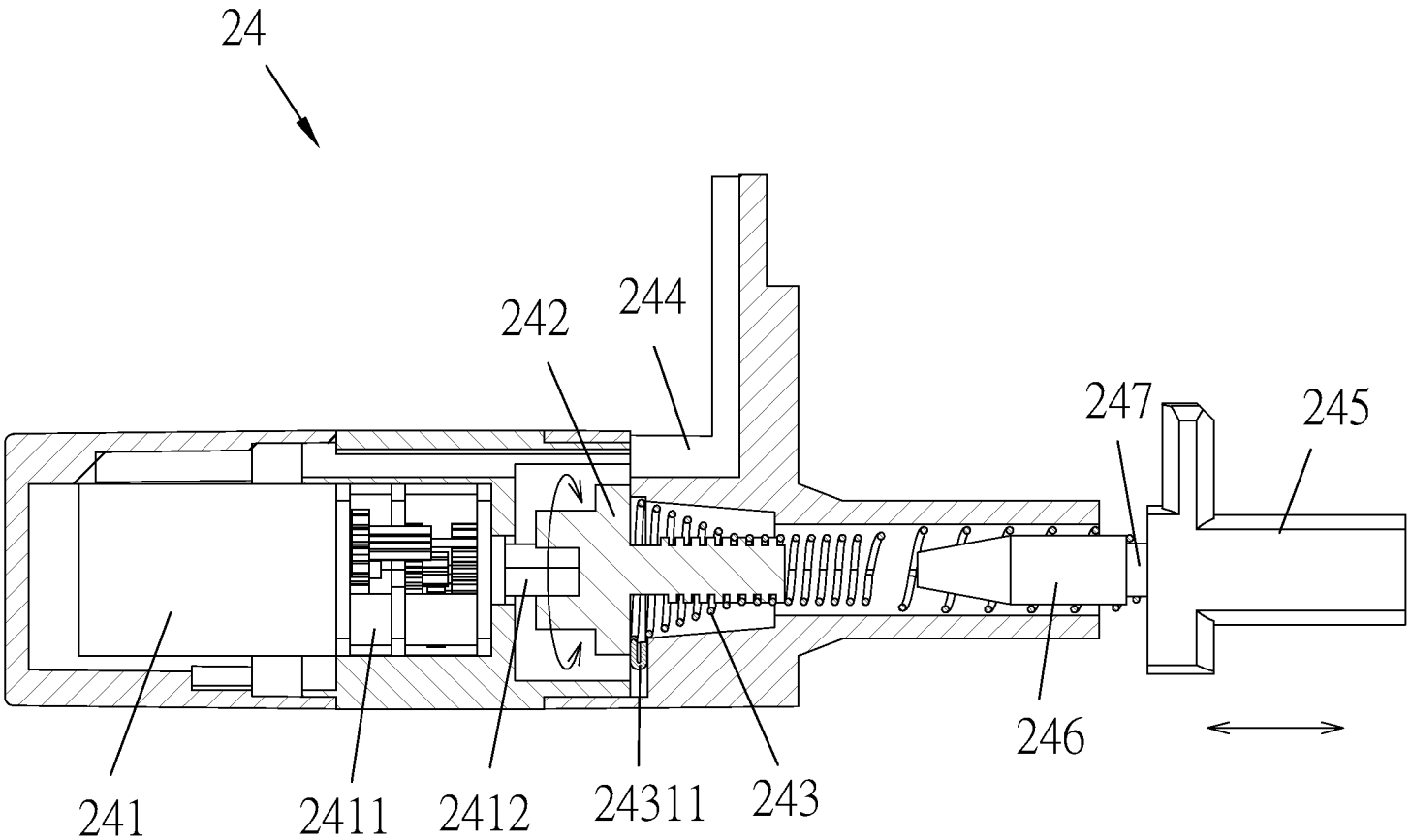
FIG. 6 is a cross-sectional view of the electrically-driven valve of the present invention.
Figure 7:
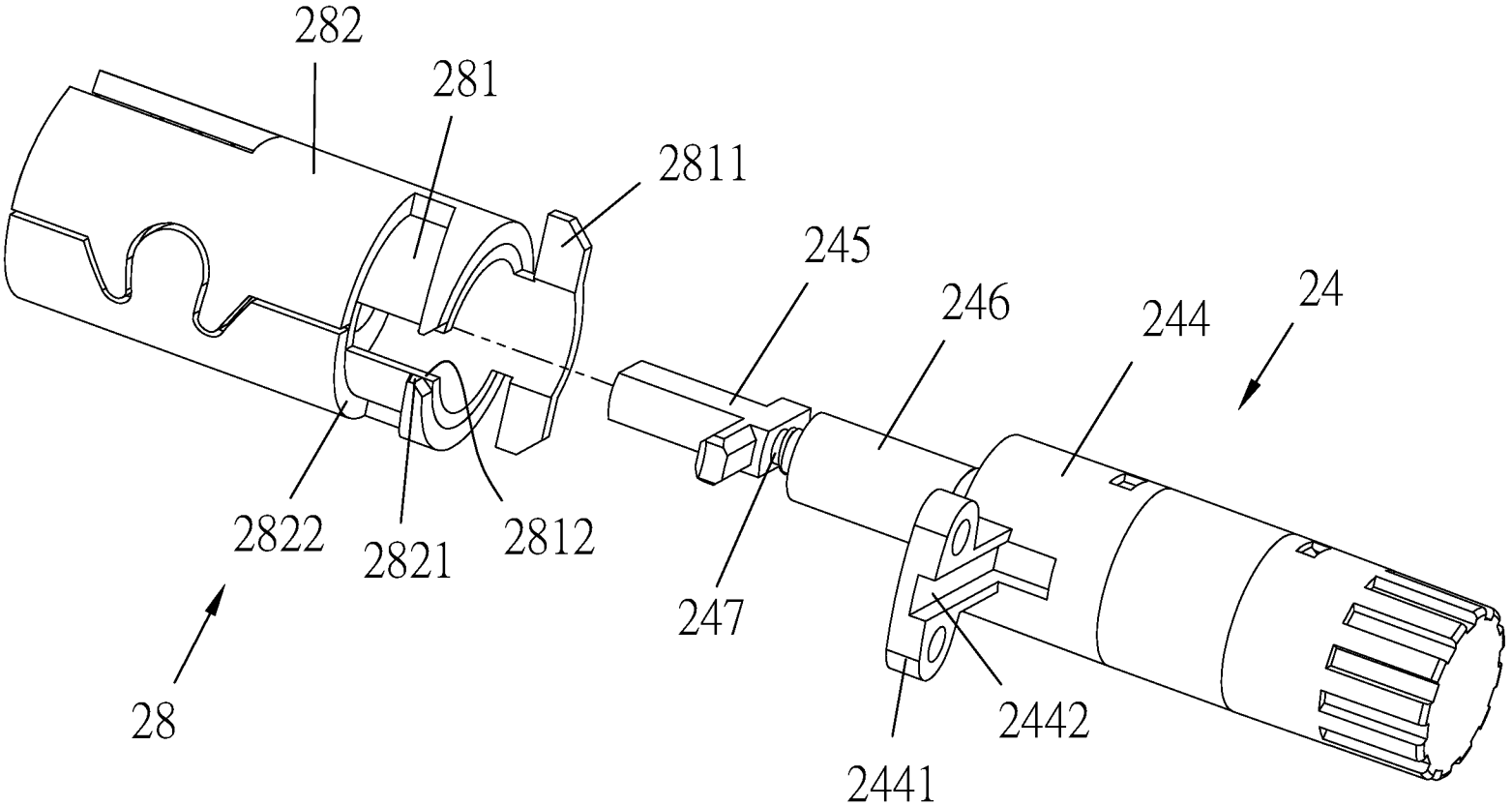
FIG. 7 is an exploded view of the electrically-driven valve and a second arrestor of the present invention.

Referring to FIG. 6, which illustrates a condition before operation and a condition of being in operation, as shown in the drawings, when the motor 241 rotates, reduction is carried out with the reduction gear train 2411 and then the rotary member 242 is driven into operation. Further, due to the rotary member 242 being coupled to the elastically extendable/contractable element 243, the rotary member 242, when rotating, drives the elastically extendable/contractable element 243 to rotate and extend in a forward direction so that the end of the elastically extendable/contractable element 243 that is in coupling engagement with the motor 241 is brought into a relaxed condition and the guide block 245 and the projection block 246 are allowed to move forward and rearward.

Since the stop section 24311 of the elastically extendable/contractable element 243 is located in the limiting section 2443, over-twisting of the elastically extendable/contractable element 243 is prevented and damage resulting from excessive deformation caused thereby is avoided.

Referring to FIGS. 2 and 3, which are respectively a partly exploded view, a schematic view illustrating engagement, and a schematic view illustrating operation of the present invention, as shown in the drawings, an engagement relationship between the electrically-driven valve 24 and the second arresting member 28 is illustrated, in which the second arresting member 28 comprises an inner tube 281 and an outer tube 282, and the inner tube 281 has an end of which one side is extended outward to form a wing plate 2811 and an opposite side is formed with a first guide notch 2812;

the outer tube 282 has an end of which one side is provided with a second guide notch 2821, and the second guide notch 2821 is in communication with a third guide notch 2822.

Referring to FIGS. 2, 3, 7, and 8, the inner tube 281 is arranged inside the outer tube 282, and the first guide notch 2812 and the second guide notch 2821 are corresponding to and in alignment with each other to allow the guide block 245 to pass, wherein the first guide notch 2812 has a width that is identical to that of the second guide notch 2821.

Figure 8:
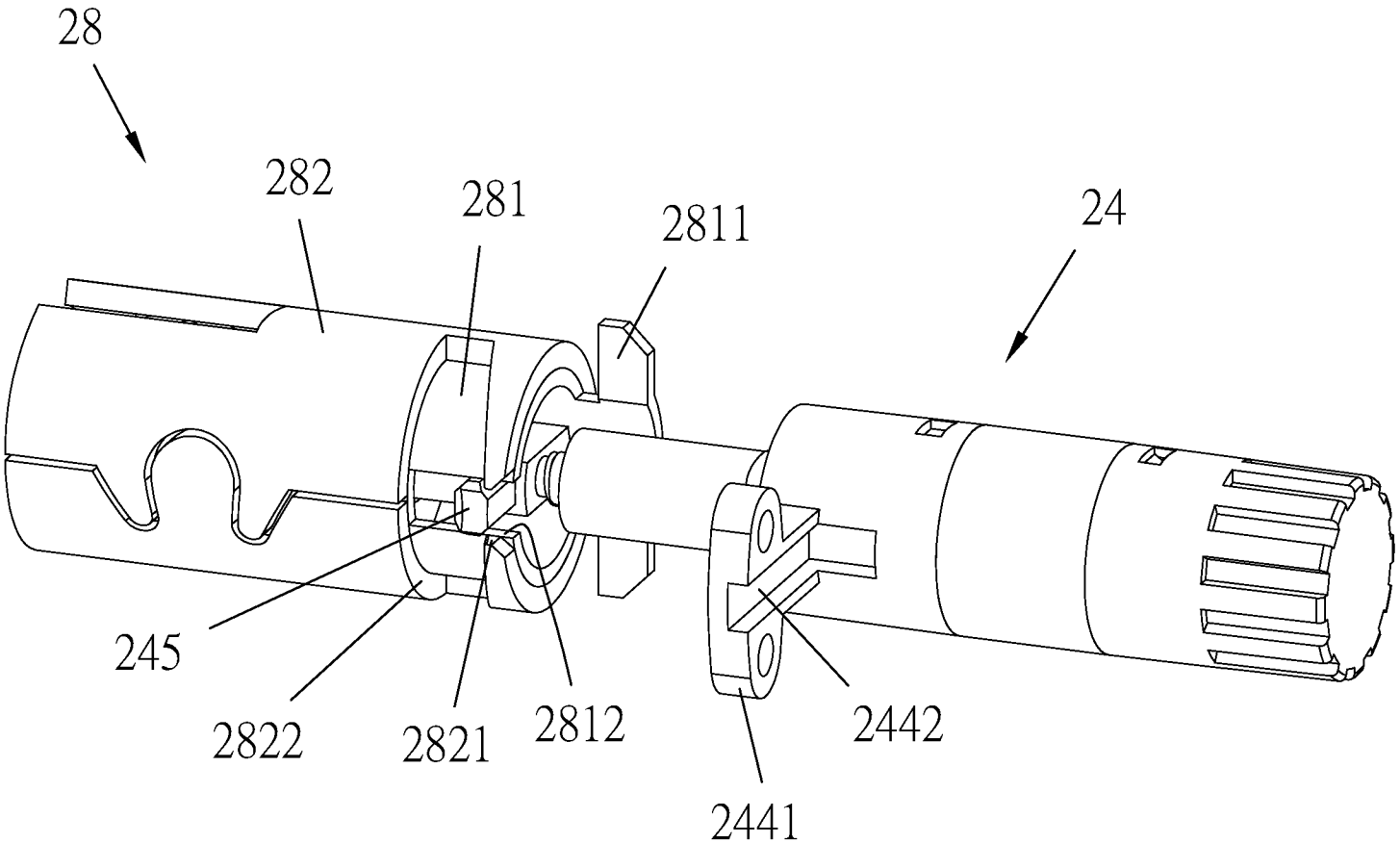
FIG. 8 is a schematic view illustrating an assembled condition as a continuation of FIG. 7.
Figure 9:
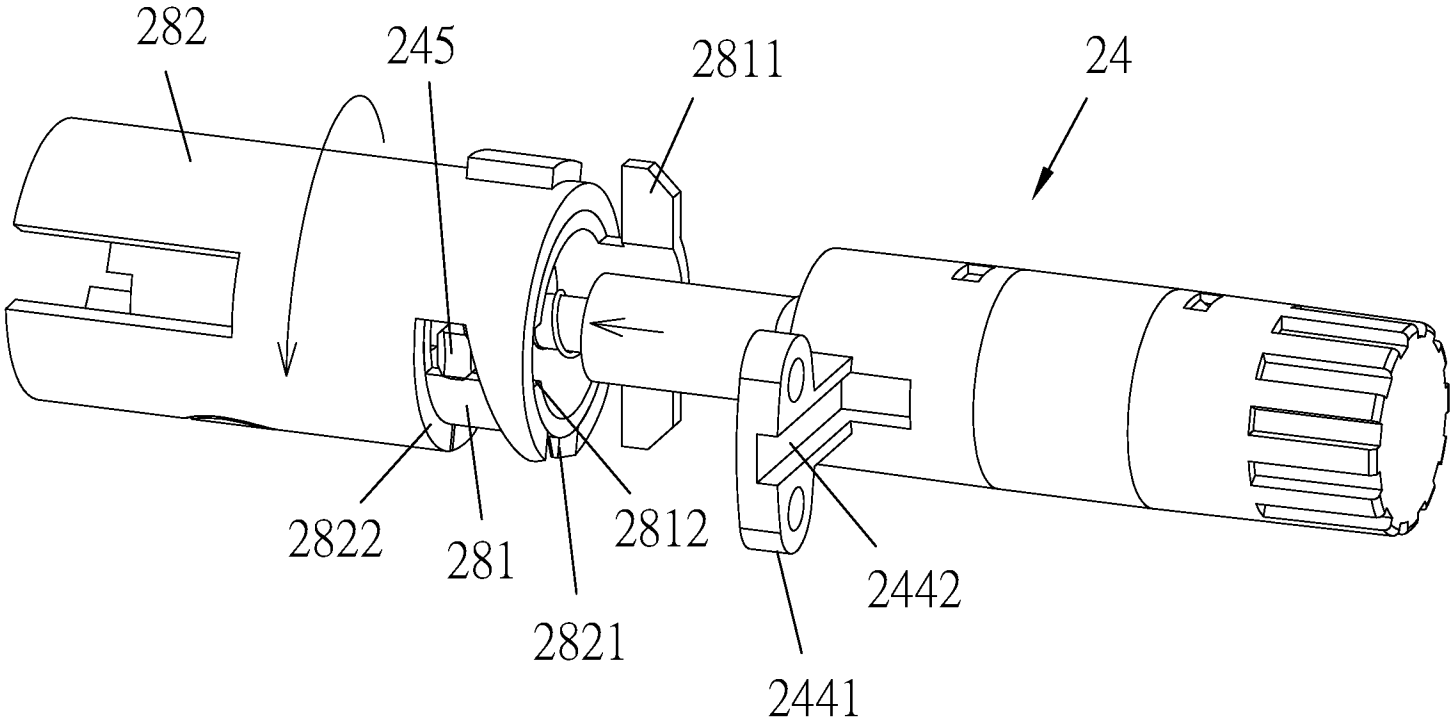
FIG. 9 is a schematic view illustrating an idle condition of the present invention.

Referring to FIGS. 8 and 9, when the electrically-driven valve 24 is in a locked condition, the projection block 246 of the electrically-driven valve 24 is received into the inner tube 281 of the second arresting member 28 and the guide block 245 is in engagement with the first guide notch 2812, while no component is made in engagement with the second guide notch 2821, so that the guide block 245 is only allowed to rotate, in an idle condition, within the third guide notch 2822 and does not drive the lock middle to rotate, making it not possible to directly open with the outside handle.

Figure 10:
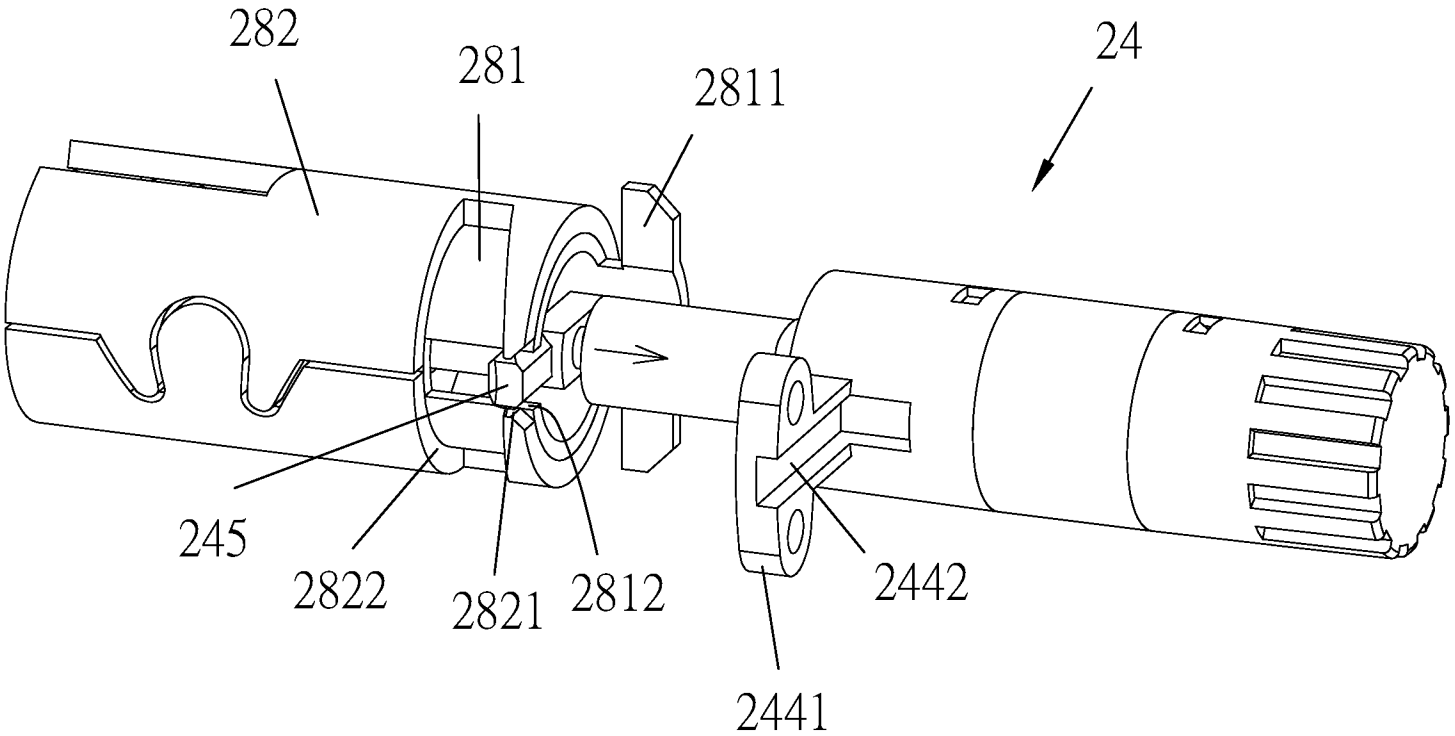
FIG. 10 is a schematic view illustrating an operation of engagement of the electrically-driven valve with the second arrestor according to the present invention.
Figure 11:
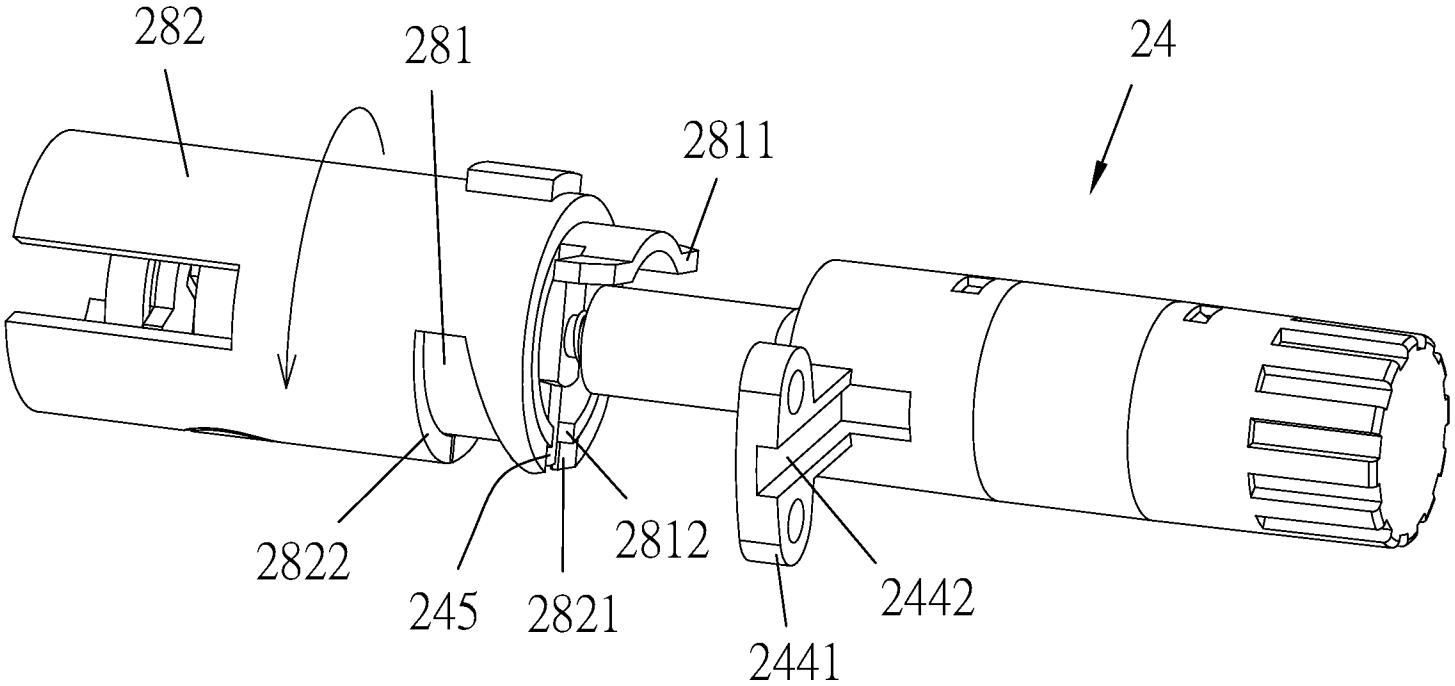
FIG. 11 is a schematic view as a continuation of FIG. 10.

Referring to FIGS. 10 and 11, when the function of electronic lock according to the present invention is put into operation, the electrically-driven valve 24 is rotated and the guide block 245 and the projection block 246 are caused to extend forward, making the guide block 245 located between the first guide notch 2812 and the second guide notch 2821, so that when the outside handle is rotated, the second arresting member 28 is also driven and thus, the present invention can be opened with the outside handle.

Figure 12:
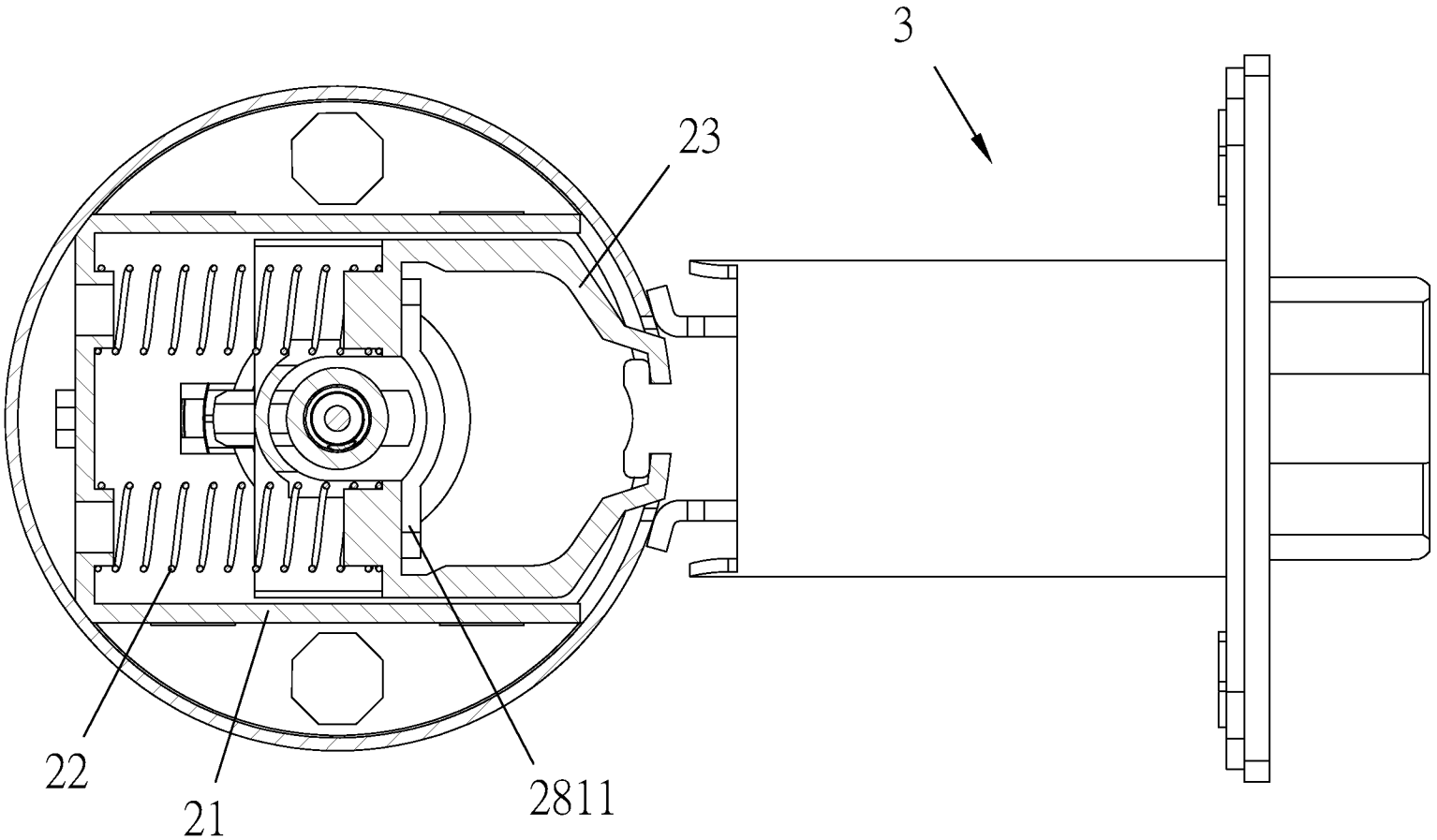
FIG. 12 is a schematic view illustrating the lock middle engaging a latch according to the present invention.
Figure 13:
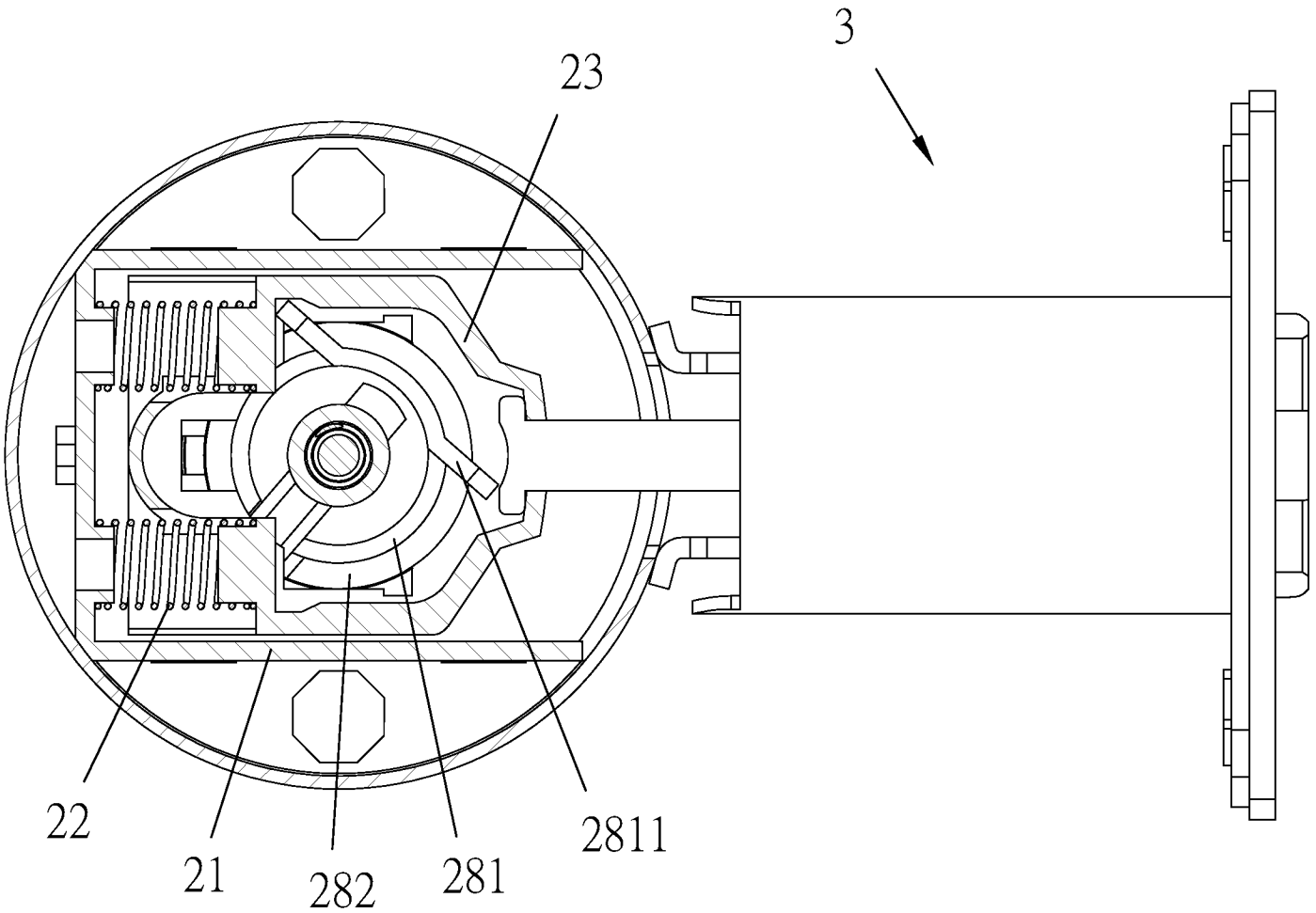
FIG. 13 is a schematic view as a continuation of FIG. 12.

Referring to FIGS. 12 and 13, which illustrate a condition before operation and a condition of being in operation, and views illustrating the lock middle 2 drives the latch to move according to the present invention, as shown in the drawings, the latch coupler 23 of the lock middle 2 is in engagement with the latch 3, so that when the lock middle 2 rotates, the wing plate 2811 drives the latch coupler 23 to move and thus the latch 3 is caused to move in combination with the latch coupler 23 to achieve opening.

I claim:

1. An electronic lock, comprising:

an outside-door assembly, wherein the outside-door assembly is mounted to an outer side of a door panel and comprises an outside handle, an outside escutcheon, an outside handle arrestor, and an outside mounting board, the outside arrestor penetrating through the outside escutcheon and coupled with the outside handle to be located at one side of the outside mounting board;

a lock middle, which is connected to the outside-door assembly and comprises a lock middle body, elastic elements, a latch coupler, an electrically-driven valve, a first arresting member, a ring, a lock middle housing, a second arresting member, and a body mounting member, the latch coupler being connected to the elastic elements and then coupled to the lock middle body, the electrically-driven valve penetrating through the first arresting member and the lock middle body and then, the ring and the lock middle housing being fit, in sequence, to the first arresting member and the lock middle body, the second arresting member penetrating through the lock middle body to be mounted by the body mounting member to the lock middle body, wherein the electrically-driven valve comprises a motor, a reduction gear train, a rotary member, an elastically extendable/contractable element, a valve casing, a guide block, and a projection block, the valve casing having one side that is extended to form a fixing section, the fixing section being formed with a groove, the fixing section having two sides coupled to the lock middle body; the motor is connected to the reduction gear train, the reduction gear train comprising a transmission axle, the transmission axle being coupled to the rotary member and received in the valve casing, conductor wires of the motor being arranged in the groove; the elastically extendable/contractable element includes a first end section and a second end section, the first end section being extended outward to form a stop section, an opposite side of the rotary member being coupled to the first end section of the elastically extendable/contractable element and received in the valve casing, the valve casing having an inside surface that is recessed to form a limiting section, the stop section being received in the limiting section, the guide block being integrally formed with the projection block, an engaging section being provided between the guide block and the projection block, the second end section of the elastically extendable/contractable element being coupled to the engaging section;

an inside-door assembly, wherein the inside-door assembly is connected to the lock middle and is mounted at an inner side of the door panel and comprises an inside handle, an inside escutcheon, an inside handle arrestor, and the inside mounting board, the inside arrestor penetrating through the inside escutcheon and coupled to the inside handle to be located at one side of the inside mounting board; and a latch, which is coupled to and is operable in combination with the latch coupler.

2. The electronic lock according to claim 1, wherein the transmission axle includes a first flat plane section, the rotary member having an end that includes an insertion hole, the insertion hole including a second flat plane section, the transmission axle being inserted into the insertion hole, such that the first flat plane section is in contact with the second flat plane section.

3. The electronic lock according to claim 1, wherein the outside handle includes a keyway, a lock core and an extended bar.

4. The electronic lock according to claim 1, wherein the outside escutcheon includes a pushbutton set.

5. The electronic lock according to claim 1, wherein the inside escutcheon includes a battery seat and is electrically connected with the electrically-driven valve.

6. The electronic lock according to claim 1, wherein the outside escutcheon includes a circuit board and is electrically connected with the electrically-driven valve.

* * * * *